US007062926B2

(12) United States Patent
Clulow et al.

(10) Patent No.: US 7,062,926 B2
(45) Date of Patent: Jun. 20, 2006

(54) SNOW MAKING

(75) Inventors: Malcolm George Clulow, Birmingham (GB); David Winnett, Birmingham (GB)

(73) Assignee: Acer Snowmec Limited, Birmingham (GB)

( * ) Notice: Subject to any disclaimer, the term of this patent is extended or adjusted under 35 U.S.C. 154(b) by 0 days.

(21) Appl. No.: 10/493,617

(22) PCT Filed: Oct. 23, 2002

(86) PCT No.: PCT/GB02/04792

§ 371 (c)(1),
(2), (4) Date: Jun. 4, 2004

(87) PCT Pub. No.: WO03/036198

PCT Pub. Date: May 1, 2003

(65) Prior Publication Data

US 2004/0261438 A1 Dec. 30, 2004

(30) Foreign Application Priority Data

Oct. 23, 2001 (GB) ..... 0125424.2

(51) Int. Cl.
*F25C 3/04* (2006.01)

(52) U.S. Cl. ..... 62/74; 62/347; 239/2.2

(58) Field of Classification Search ..... 62/74, 62/347, 426; 239/2.2
See application file for complete search history.

(56) References Cited

U.S. PATENT DOCUMENTS 4,742,958 A * 5/1988 Bucceri ..... 239/2.2
4,916,911 A * 4/1990 Duryea et al. ..... 62/70
5,083,707 A * 1/1992 Holden ..... 239/2.2
5,327,738 A * 7/1994 Morioka et al. ..... 62/74
5,400,966 A 3/1995 Weaver et al.
5,836,514 A * 11/1998 Handfield ..... 239/14.2
6,079,161 A * 6/2000 Tomioka et al. ..... 52/1
6,129,290 A * 10/2000 Nikkanen ..... 239/2.2
6,295,824 B1 10/2001 Katayama
6,464,148 B1 * 10/2002 Costa et al. ..... 239/2.2
6,796,368 B1 * 9/2004 Saida et al. ..... 165/43

FOREIGN PATENT DOCUMENTS

CA 1 057 069 A 6/1979
EP 0 004 803 A 10/1979

(Continued)

OTHER PUBLICATIONS

Patent Abstract of Japan, vol. 2000, No. 13, Feb. 05, 2001 & JP 2000 283616 A, Oct. 13, 2000.

*Primary Examiner*—William E. Tapolcai
(74) *Attorney, Agent, or Firm*—Nixon & Vanderhye P.C.

(57) ABSTRACT

Method for making snow wherein snow is made within a closed environment by discharging water droplets into a body of air maintained by air conditioning means at a temperature and humidity such as to turn the water droplets into snow, falling on to a surface including coolant pipes which are covered with a layer of snow, the coolant being at a lower temperature than the air temperature such that there is a temperature gradient in the snow layer of the order of 0.1 degrees centigrade per centimeter depth, whereby during the initial part of the process a small quantity of small droplets is discharged to provide nucleating particles, and thereafter a larger quantity of droplets is discharged and whereby incoming air to be discharged into the body of air is drawn over cold surfaces.

11 Claims, 8 Drawing Sheets

FOREIGN PATENT DOCUMENTS

Figure 1:
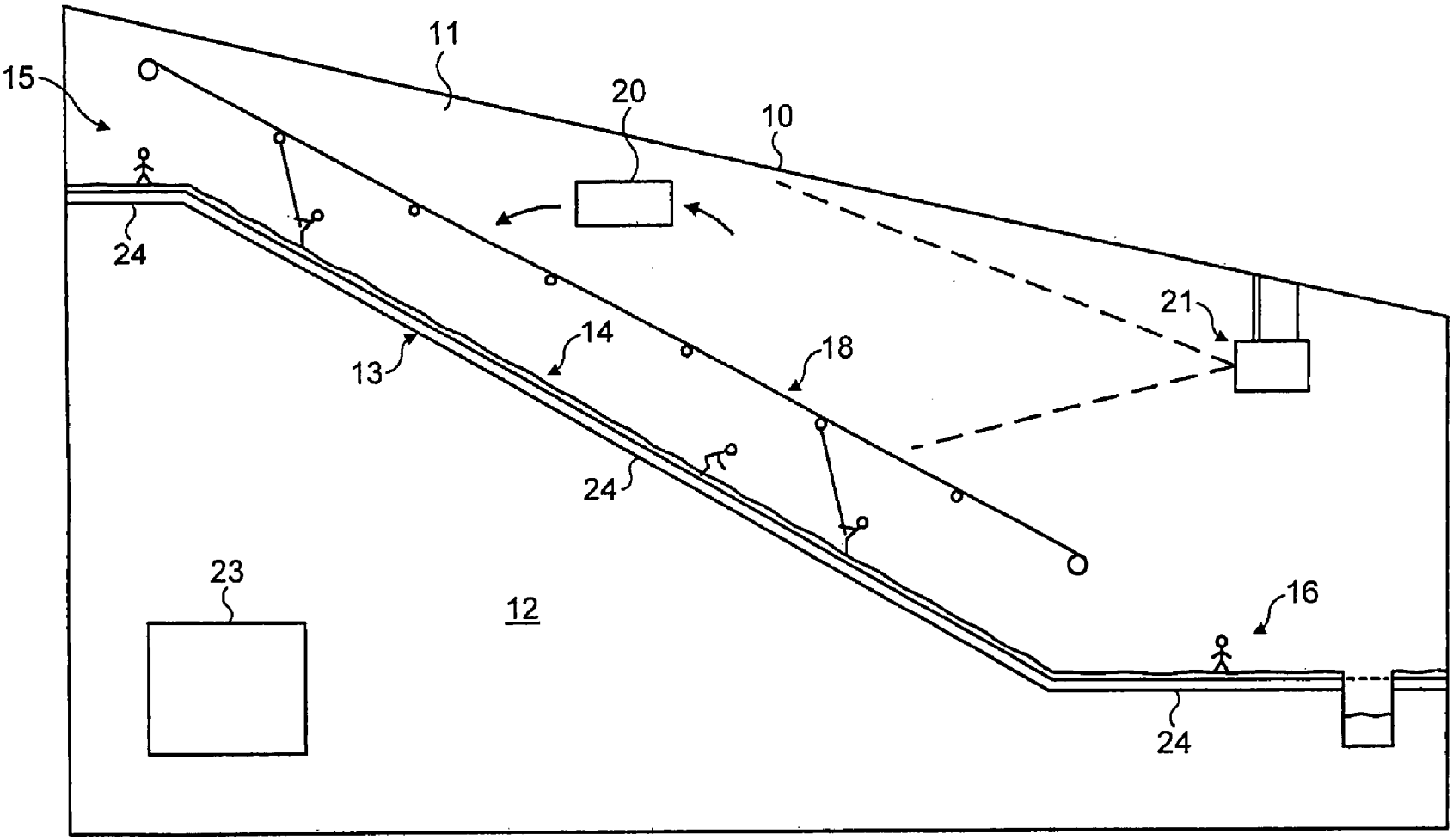

| | | |
|---|---|---|
| EP | 0 378 636 | 7/1990 |
| EP | 0 658 732 A | 6/1995 |
| FR | 2 363 770 A | 3/1978 |
| GB | 2 248 921 A | 4/1992 |

* cited by examiner

SNOW MAKING

This application is the U.S national phase of international application PCT/GB02/04792 filed in English on 23 Oct. 2002, which designated the U.S. A PCT/GB02/04792 claims priority to GB Application No. 0125424.2 filed 23 Oct. 2001. The entire contents of these applications are incorporated herein by reference.

This invention relates to snow making and in particular to apparatus and a method for making snow within an indoor environment.

It has been proposed, for example, in European patent specification 0378636, to make snow within a closed environment usually for recreational purposes such as skiing.

Operational problems have become apparent in such installations and an object of the invention is to improve the operation of indoor snow making facilities and to provide improved conditions within the facility without prejudicing the operational costs.

When real, artificial snow is generated indoors there needs to be strict control of the indoor environment with regard to temperature and humidity, as taught in European specification 0378636. The present application is concerned with achieving such control.

Snow produced rests on a surface, usually kept cold, but the snow quality can deteriorate quickly if the conditions are not controlled. It is a further object to control the condition of the snow layer.

Usually, snow is produced by providing a spray of water into the closed environment so that the water turns into snow before falling on to the snow surface. It has been found that the production of the droplets has a significant effect on the production of snow and it is an object to improve the discharge of water droplets into the environment.

According to the invention there is provided a method of making snow wherein snow is made artificially by discharging water droplets into a body of air within a closed environment, which body of air is maintained at a temperature and humidity at least during snow making such as to turn the water droplets to snow, the snow falling on to a surface within said environment, the surface including coolant pipes which in operational use are covered with a layer of snow and the temperature of the coolant in said pipes is maintained such that the temperature gradient in the snow layer between the coolant and the air above the snow layer is of the order of 0.1 degrees centigrade per centimeter depth, the coolant being at a lower temperature than the air temperature.

Preferably the pipes are spaced apart over said surface and a thermally conductive material is laid over the pipes and under the snow in use to improve the conduction of the heat of the coolant to the snow layer.

Figure 2:
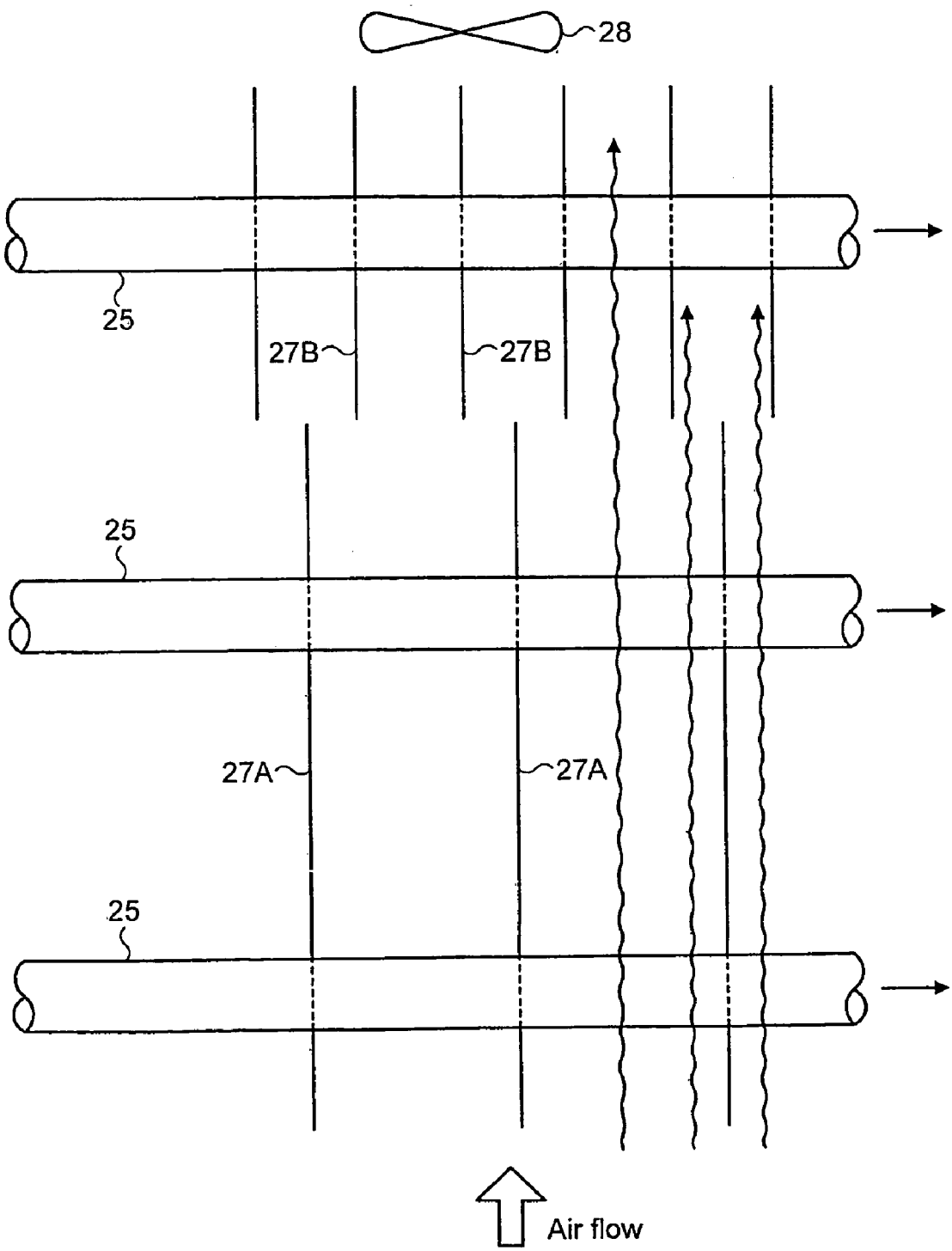
Figure 3:
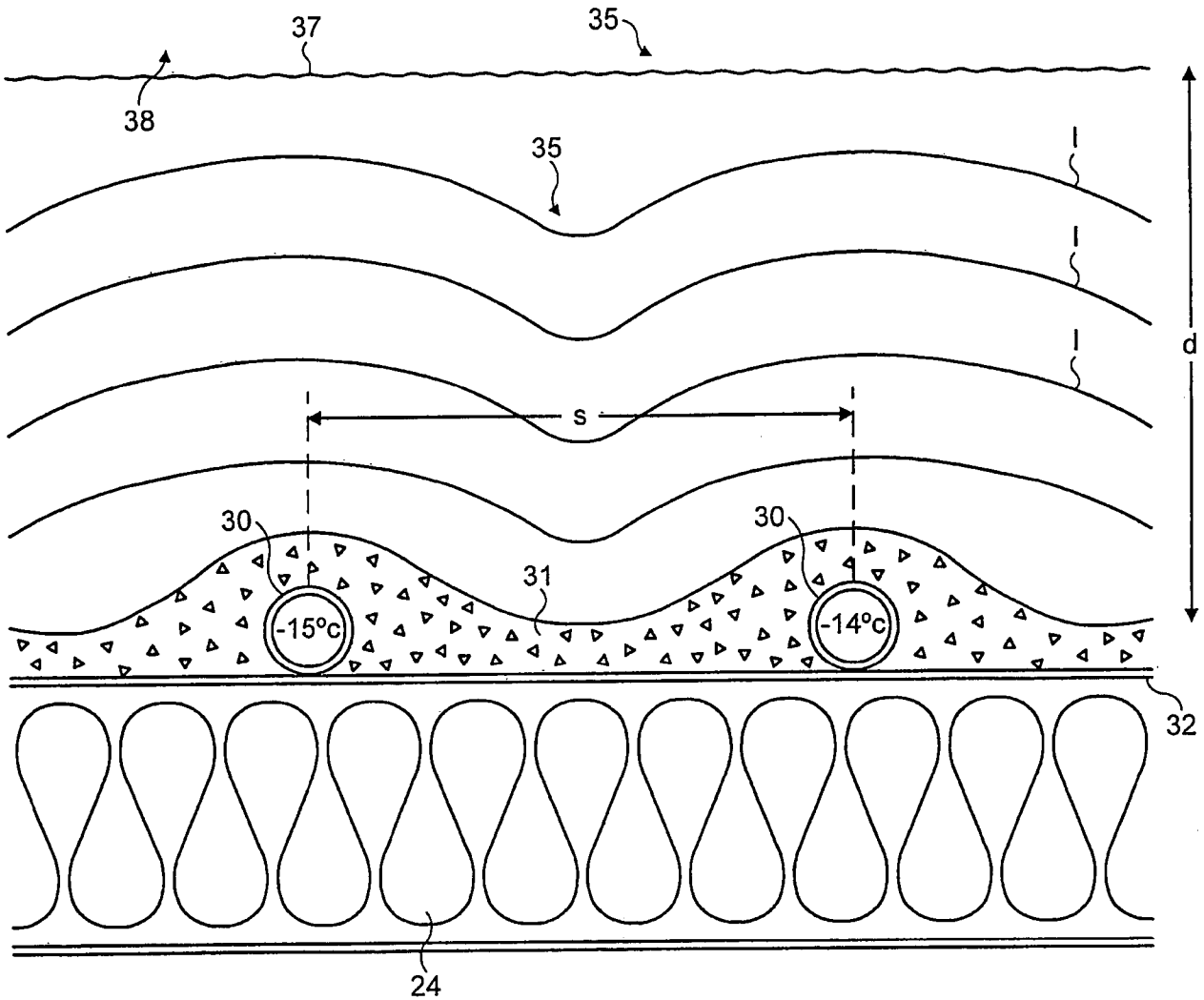
Figure 4:
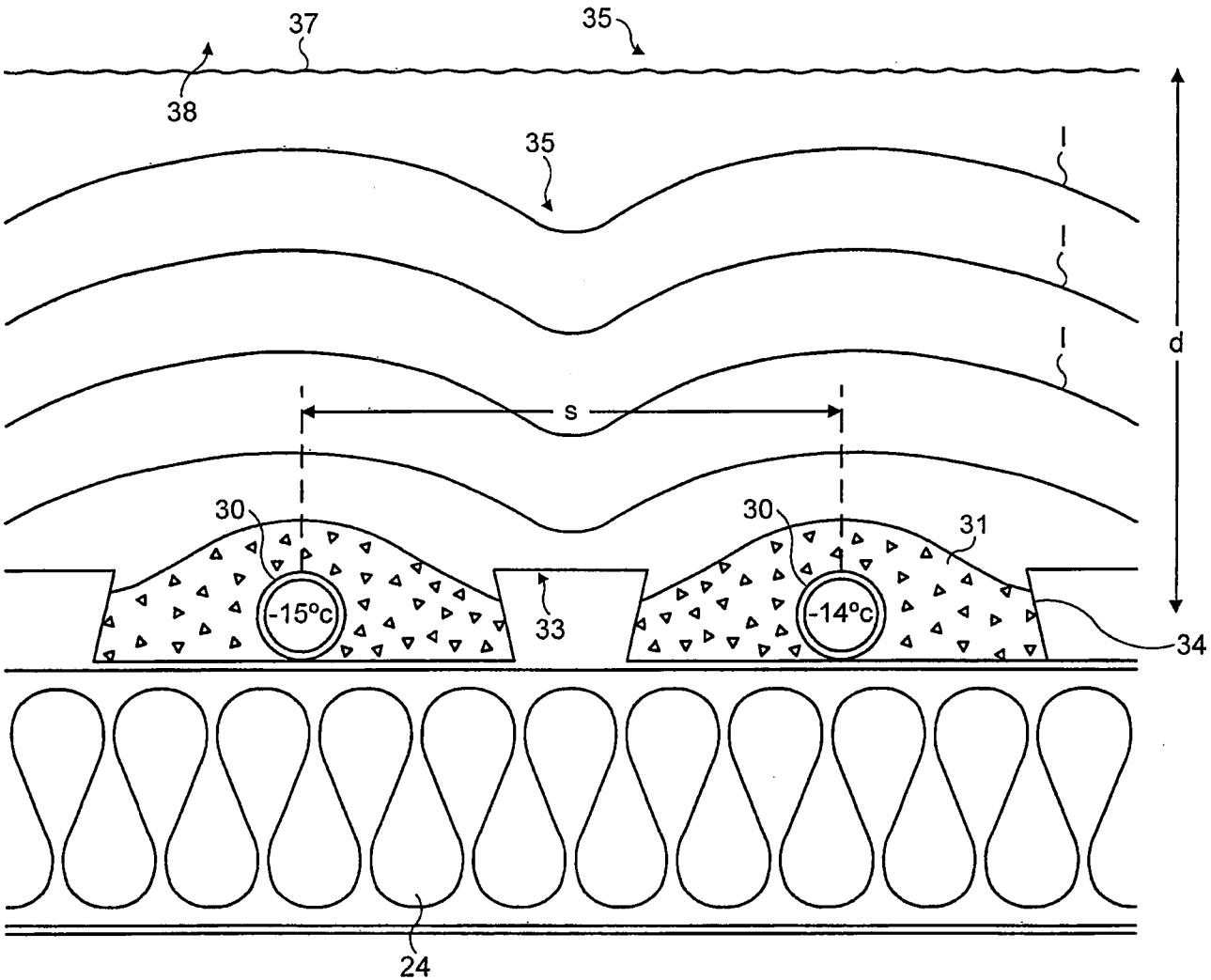
Figure 5:
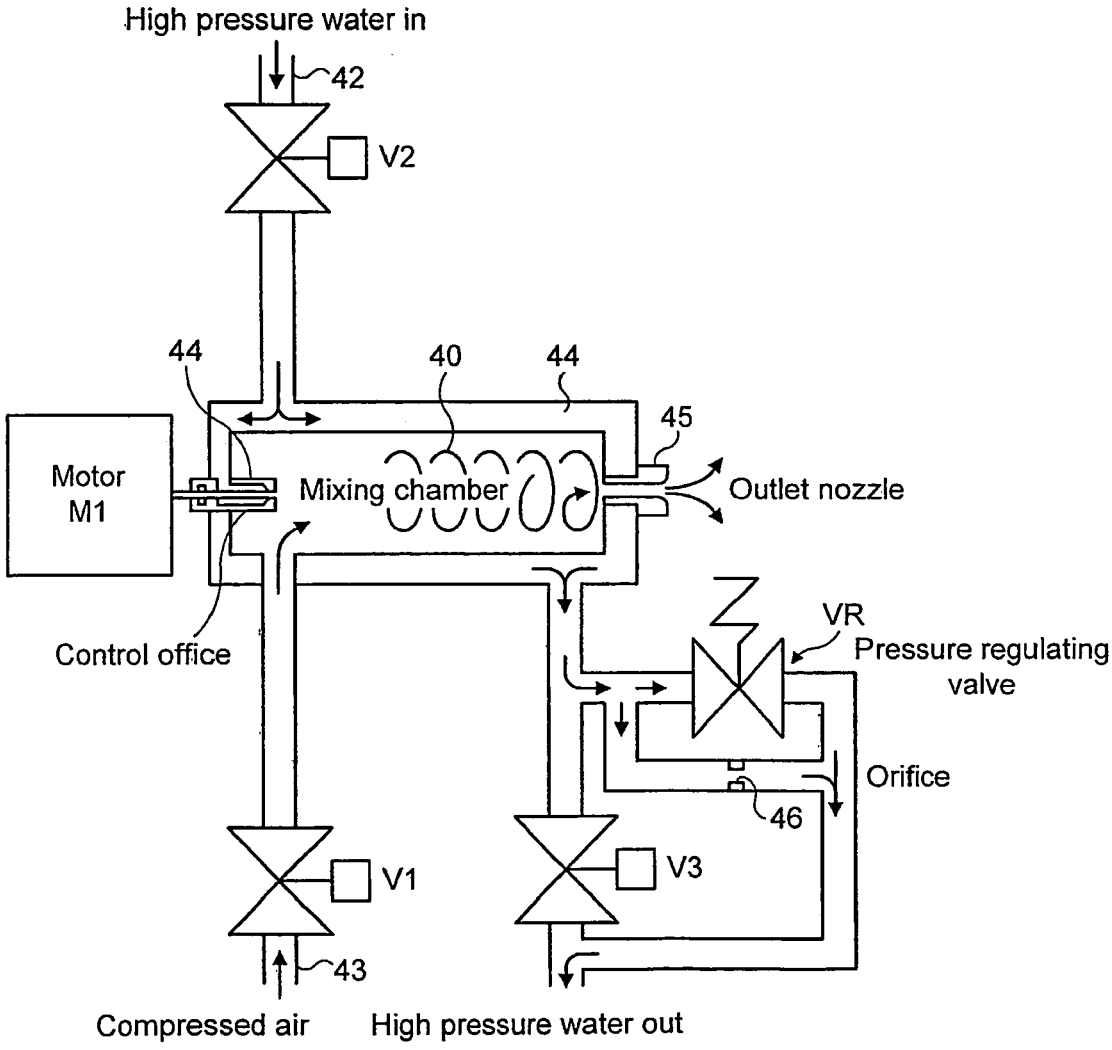
Figure 6:
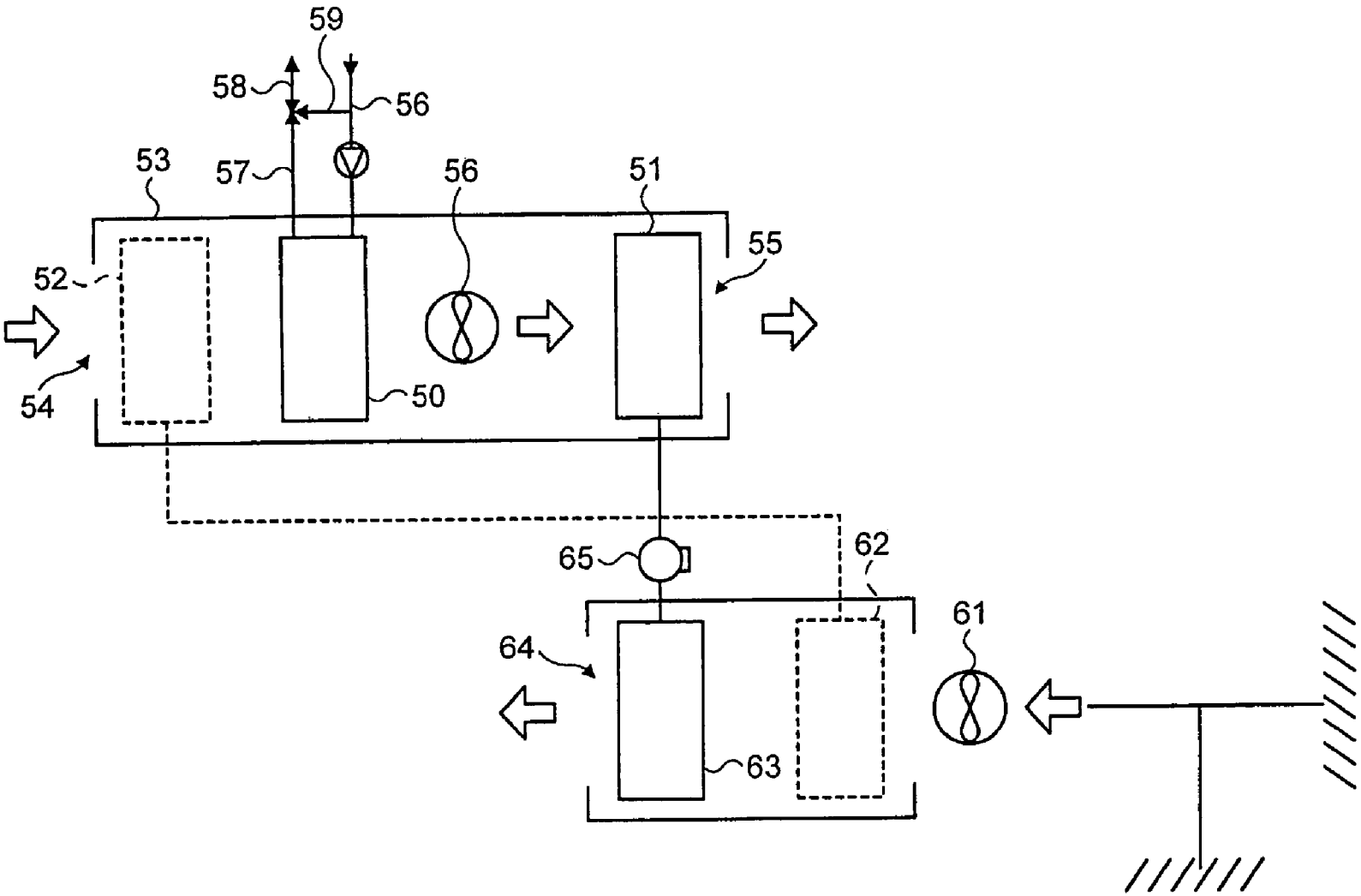
Figure 7:
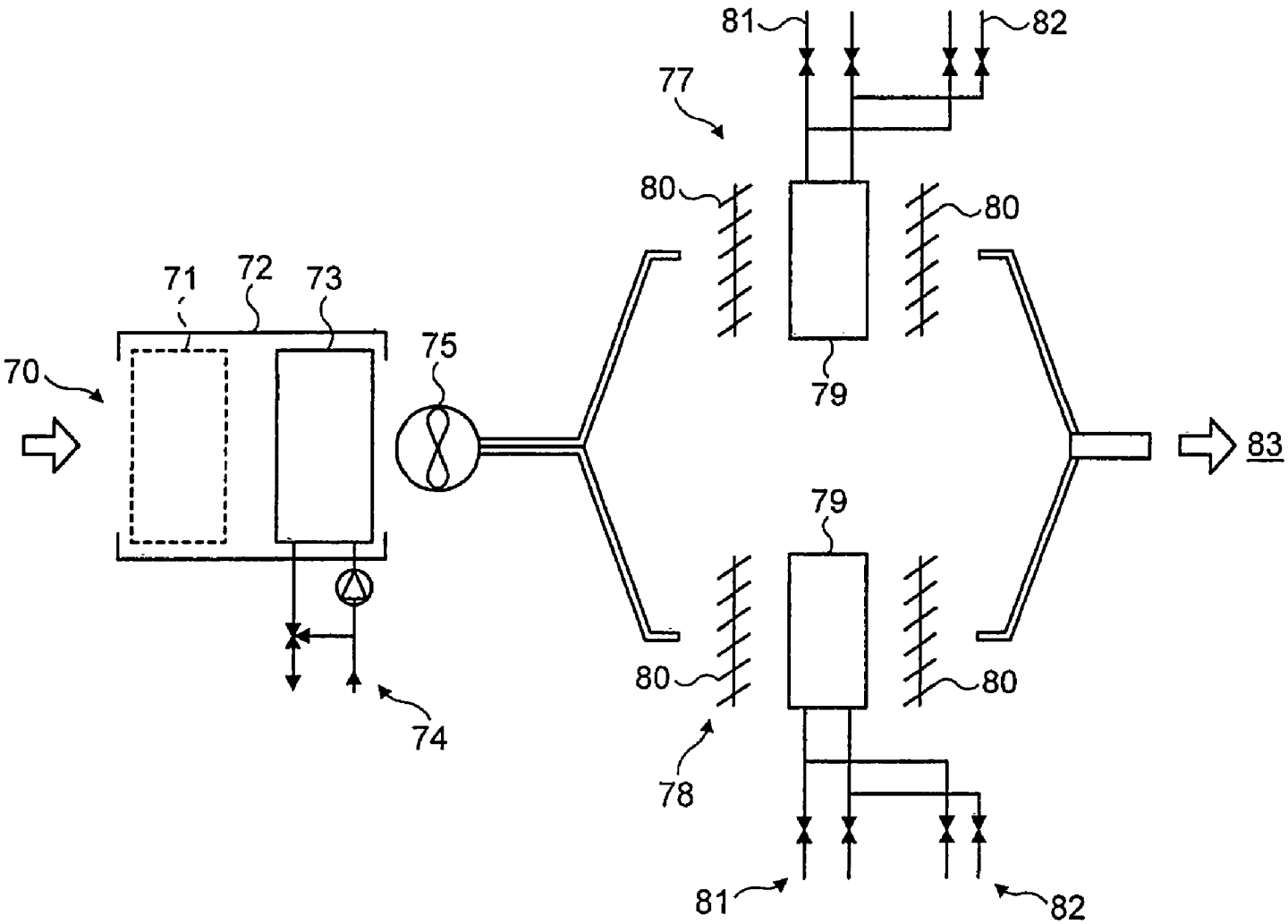
Figure 8:
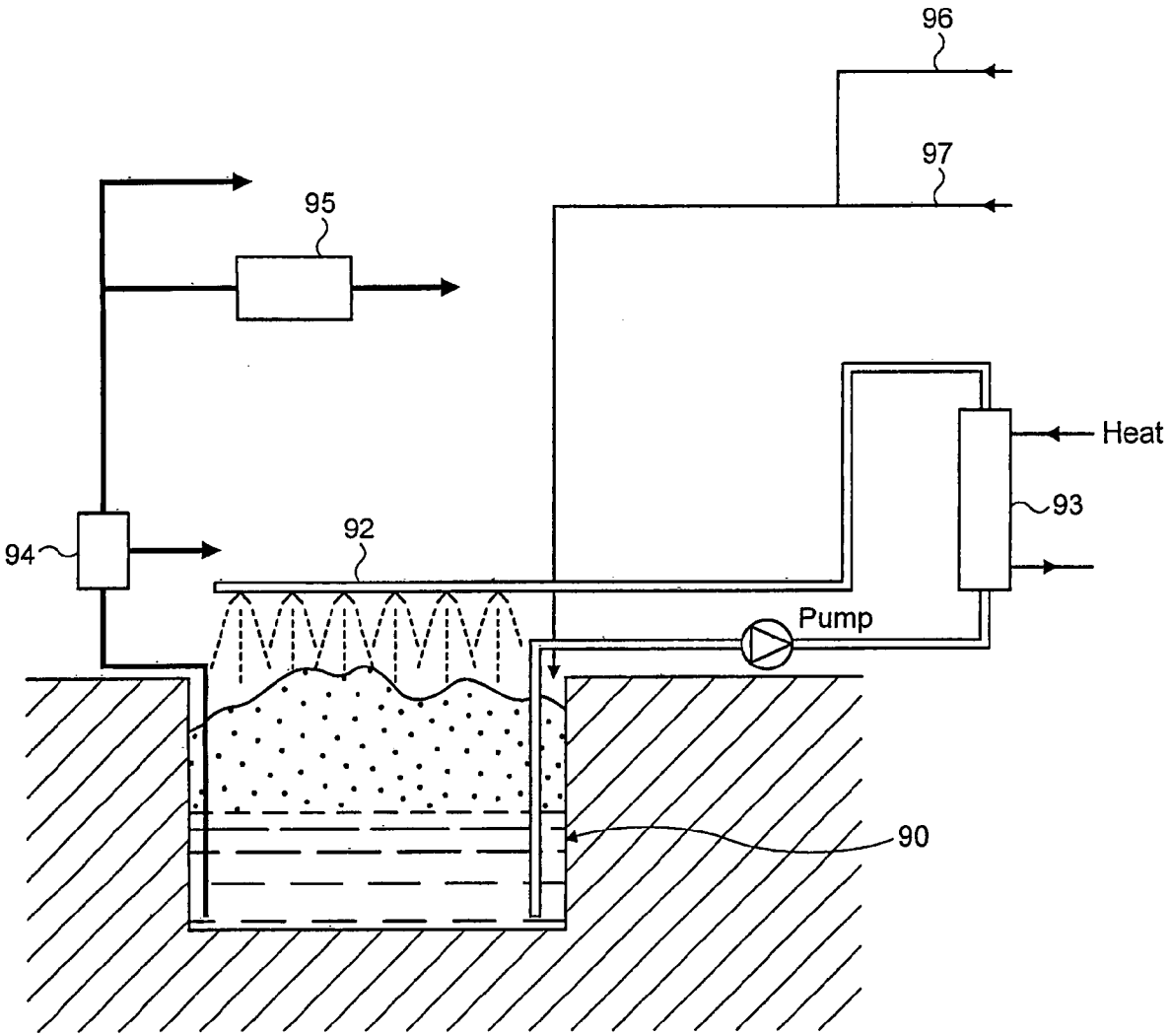

Various features of the invention will become apparent from the following description given with reference to the drawings by way of example only. In the drawings:

FIG. 1 is a vertical schematic section through an indoor snow installation;

FIG. 2 is a schematic section through part of a heat exchanger for cooling air, FIG. 3 shows a cross section through the snow supporting surface in one arrangement, FIG. 4 shows a cross section similar to that of FIG. 3 of another arrangement, FIG. 5 is a schematic drawing of a snow gun, FIG. 6 is a schematic view of ventilation control means, FIG. 7 is a view of alternative ventilation control means, FIG. 8 is a schematic view of a water recycling arrangement, Referring to the drawings and firstly to FIG. 1 there is shown a typical indoor snow installation. Usually a building 10 is provided which is divided into upper and lower regions 11 and 12, the upper region 11 defining a body of air within the region in which snow is made and the region 12 being below the region 11 and separated therefrom by a dividing structure 13 which defines at its upper side a slope 14 having at its upper end a flat region 15 and at its lower end a run off region 16. Transport means 18 is provided for elevating users from the lower run off 16 to the region 15.

Within the area 11 is located air conditioning means 20 for conditioning the air within the body of air and snow gun means 21 by which water droplets are discharged into the body of air to be formed into snow which falls on the surfaces of areas 14, 15 and 16. The lower region 12 can contain the refrigeration equipment 23 for the air conditioner 20 and snow gun 21, but this may be contained outside the building 10. The air conditioner 20 usually includes cooling of air from the region 11 by recirculation and the cooling and dehumidifying of air from outside by separate units.

Access into the building 10 and to the different areas 11 and 12 is provided through doorways or other openings (not shown). The structure 13 is insulated over its underside at 24 and the walls of the building 10 are also insulated, at least over that portion which envelopes the body of air 11.

The air conditioning equipment 20 is connected to a source of coolant from the refrigeration means 23 and the coolant is arranged to pass through pipes or ducts 25 such as shown in FIG. 2. The pipes 25 are spaced apart and lie parallel to one another and air is directed over the pipes 25 in the direction generally transverse to the length of the pipes, the direction 4 as shown in FIG. 2.

To ensure good heat transfer between the air and the coolant in the pipes there is usually provided a series of fins 27, the planes of which lie parallel to the direction of flow and fins being connected to the pipes thermally and physically.

In FIG. 2 there is shown a heat exchanger by which air entering the indoor environment is cooled having regard to the need to keep the humidity of the air at below 100%, ideally at below 95% humidity. The relative humidity of the air within the environment also has an effect on the kind of snow which is produced. For example, in producing a powder snow, a typical temperature of the air would be −15° C. with a relative humidity of between 90% and 95%. A soft snow can be produced at a temperature of around −2° C. with a relative humidity below 100% but somewhat in excess of 95%. However, if the humidity of the air within the environment raises to 100% or near, then the formation of snow within the environment is difficult and inefficient and a freezing fog will be produced rather than snow.

Hitherto, in order to obtain the desired temperature and humidity of air within the environment, the incoming air has been cooled down to below the preferred room temperature dew point and then re-heated to lower the humidity of the air to below 100%. Such an arrangement is expensive in equipment terms and operational costs.

The illustrated arrangement of FIG. 2 is intended to achieve the conditions required through use of a suitable construction of heat exchanger in the form of coolant pipes or ducts 25 across which extend heat exchange fins 27.

It is to be expected that ice forms on the fins of the heat exchanger during cooling and the heat exchanger is arranged to have a wide spacing between the fins of the order of 8 mm spacing. However, with a relatively wide spacing between the fins only the air in contact with the fins will be cooled significantly and the air midway between the fins will be cooled insufficiently. This results in some air being cooled to below the required temperature and some air bypassing the cooling effect of the fins. To take advantage of this bypass effect and thus obtain a leaving air condition below saturation, i.e. less than 100% humidity, a fan 28 is placed across the outlet of air from the fins whereby to mix the saturated and non-saturated air and obtain a desired mean moisture content. The fan 28 may have a variable drive speed so that mixing of the air paths and the air velocity over and between the fins can be obtained. It is necessary to change the environment in the body of air depending on whether the environment is occupied or unoccupied by users, and whether snow is being made, or not, and other factors. Accordingly, different air flows and different temperatures are required at different times.

In FIG. 2, the fins 27 in the heat exchanger are staggered so that fins 27A over one region are located between fins 27B in another region, having regard to the direction of flow of air 4 over the fins 27. This arrangement is such as to cause air between the fins in one region to pass close to the fins in another region thereby creating the beneficial bypass effect By this means, it should be possible to provide the required temperature and humidity levels of the air leaving the heat exchanger without the requirement of reheating the air.

Air at the required temperature and humidity is discharged into the body 11 of air within the closed environment to create an environment suited to snow making. As will be described, snow formation results from discharging small droplets or particles of water into the environment so that the water particles freeze and are turned into snow which then falls on to surfaces 14, 15 and 16 which are to be used for recreational purposes such as skiing. It is important that the snow on such surfaces is retained in good condition and does not change into ice or otherwise lose its important snow characteristics, including whiteness and slipperyness.

For this purpose, the surface carrying the snow is kept to below freezing temperature by providing coolant ducts or pipes 30 (FIGS. 3 and 4) distributed over said surface. Once the snow has been placed on the surface, then the pipes 30 should be below this surface in order to prevent them from being damaged or from being a hazard to skiers and other users. The location, spacing and other aspects concerning the pipes and the temperature of the coolant determine whether the cooling effect of coolant passing through the pipes is able to maintain the snow in the desired condition. A close spacing between the pipes is of assistance but gives rise to high cost consideration.

Snow is a poor thermal conductor which is another consideration and the underside of the surface needs to be thermally insulated as at 24 in order to prevent loss of heat. Ideally isothermals I present in the snow layer should have even profiles so that the quality of snow on the surface is retained evenly over such surface.

Referring to FIGS. 3 and 4 of the drawings, there is provided coolant pipes 30, usually parallel to one another and spaced apart and extending transversely across the slope of surface 15, which are embedded in thermally conductive material 31 and lying on a flat surface 32 (FIG. 3). Such material may be activated alumina in the form of granules and bound with ice. Alternatively, the material may be activated alumina bound with cement to form a concrete material. If activated alumina is bound with cement this may be in the ratio of between 10 and 50% by volume activated alumina, to between 90 and 50% cement and ballast mix in the resulting concrete.

Alternatively, the pipes 30 may be located in a profiled surface 33 (FIG. 4) having recesses 34 whereby the pipes 30 are located in the recesses in said surface and the recessed area may be filled with the activated alumina or activated alumina/cement 31 and this has the effect of reducing the amount of thermally conductive material which needs to be present over the pipes. The isothermal profile with such an arrangement may be as shown in the drawings.

Snow is formed in a layer 36 having a surface 37 and the surfaces 32 and 33 have a layer of insulation 24 to insulate the surfaces.

In either embodiment the alumina/alumina concrete may be omitted so that the pipes 30 are directly embedded, in use, in the snow layer.

It has been found that a strong relationship exists between the quality of snow in the layer of snow on the surfaces and the temperatures of the air and of the surface on which the snow rests. In order to maintain quality, the temperature of the coolant in the pipes, the thickness of the snow and the temperature of the air within the environment above the snow all play a part. The greater the thickness of the snow, the more difficult it is to maintain snow quality and this has to be set against the need for the snow to be of a minimum thickness. Often the temperature of the coolant in the pipes can vary within a range of, for example, −10° C. to −20° C. preferably below −15° C. The temperature of the air within the closed environment can also vary between about 0° C. and −5° C. preferably below −5° C. The temperature of the coolant is always likely to be less than the air temperature, thereby setting up a temperature gradient through the snow determined by the differences in temperature but ideally not less than 0.1° C. per centimeter thickness of snow.

Another factor is that the isothermals I formed in the snow, i.e. points of the same temperature within the snow, which, if uneven, will give rise to portions of the snow which are of too high a temperature giving rise to bands of snow of different consistency in parts of the layer. Accordingly, the cooling effect of coolant under the snow layer needs to be as evenly distributed as possible and the arrangements shown in FIGS. 3 and 4 are intended to achieve this primarily by spreading the cold temperature of the coolant through a thermally conductive layer, in this case formed of activated alumina embedded in ice, or activated alumina concrete in which the activated alumina is embedded in cement. The spacing 5 of the pipes 30 is also an important factor to maintain isothermals of the desired profile.

Typically, the depth of the snow layer is of a thickness of 200–1000 mm and it has been found that applying the temperature gradient referred to, and within the range of temperatures of the coolant and the air referred to above, the quality of the snow in the layer can be maintained. This is due to the snow needing to be in a state of constructive metamorphism in which it is cold enough to maintain its snow like state in most parts of the snow layer. It will be evident that if the air temperature or the coolant temperature is changed from the ranges mentioned, changes in the other parameters will be able to maintain the state of snow as required.

In general the difference between the temperature of the air in space 38 and the mean temperature of the alumina or alumina/cement must be greater than the depth of snow in centimeters times a factor of 0.1 for a snow density of 0.4 tonne per cubic meter.

The water particles or droplets discharged into the closed environment are produced by a "snow gun" which usually is arranged to discharge a mixture of cold air and water particles into the cooled body of air having the desired humidity and temperature.

In FIG. 5 of the drawings there is shown an arrangement for producing the air/water discharge from the snow gun.

The snow gun comprises a chamber 40 defined by a jacket 41 through which water is circulated from a water inlet 42. Into the chamber 40 is discharged a flow of compressed air from inlet 43. The water from the jacket is discharged into the chamber 40 through orifice 44 and the air and water are discharged from the chamber through an outlet nozzle 45. In the illustrated arrangement, the orifice 44 through which the water is discharged into the chamber 40 is adjusted to control the rate of flow of water through the orifice, by a motor M1.

The motor M1 may be controlled to operate according to the relative humidity of the body of air detected in the indoor environment 11 so that as the humidity rises the amount of water discharged from the snow gun is decreased by operating the motor M1 to reduce the control orifice size and increase the ratio of air to water. By this means, the relative humidity is reduced which in turn results in re-stabilisation of the environment and improved snow crystal formation.

In the illustrated arrangement, the water can be at a pressure of between 10 bar and 40 bar and the pressure can be in the range of 3 bar and 20 bar. The water pressure will always be at a higher pressure than the compressed air pressure.

The illustrated snow gun is intended to produce water droplets of a range of particle sizes including smaller particles which can act as nucleators about which snow formation takes place.

At the start of a snow making process there are no free floating droplets or nucleators within the body of air which makes the formation of snow difficult Once suitably small droplets of water are dispersed throughout the body of air 11 they are drawn into the plume of air containing larger water droplets created by the snow gun and snow making then proceeds efficiently. Any reduction in the efficiency of snow making increases the adiabatic cooling effect of the water droplets which results in a loss of water to water vapour and increases the humidity of the body of air. This results in more ice being deposited on the heat exchange cooling surfaces which in turn reduces their efficiency and causes it to be necessary to defrost the heat exchanger frequently. If the evaporation of the water droplets is not controlled, the humidity in the body of air will rise out of control resulting in no formation of snow and freezing fog condition within the body of air.

In the illustrated snow gun of FIG. 5 the pressure within the chamber 40 is determined by the inlet air pressure, the water flow rate into the chamber and the size of the outlet opening of the outlet nozzle.

The chamber 40 is surrounded with the jacket 41 of water through which high pressure water circulates from a valve V2. Water from the jacket enters the mixing chamber through an orifice 44 of which the size is controlled by the motor M1. Air enters the mixing chamber at a predetermined high pressure which is controlled by a valve V1. When there is no water flow into the chamber 40 the nozzle outlet 45 allows a high rate of flow of compressed air from the chamber. After a predetermined time has elapsed the air flow rate becomes constant. If water valve V2 is then opened high pressure cold water circulates through the jacket which cools the water temperature to close to the freezing point of water. The water pressure within the jacket is controlled by the orifice valve 40, a pressure relief valve $V_R$ and by the orifice of a valve V3, which determines the amount of water which bypasses the system.

By maintaining a reduced water pressure within the jacket 40 by adjusting the water flow using motor M1 the flow rate of the water through the inlet orifice 44 is reduced. This gives a high ratio of compressed air to water in the range 200:1 to 150:1. This results in the size of the water particles being in the range of 5 to 60 microns which gives a high proportion of nucleating water particles.

The snow gun efficiency is maintained by the Joule Thompson effect from the compressed air and water. As the air pressure falls, the temperature of the fluid also falls as in the equation:

$$\frac{P_1 V_1}{T_1} = \frac{P_2 V_2}{T^2}$$

As the temperature of the fluid is close to 0° C., the cooling effect will enhance the formation of ice crystals to start the nucleation process within the air/water plume.

After a predetermined time has elapsed, the solenoid V3 is closed and the water pressure in the jacket 41 rises to the pre-set pressure determined by the pressure regulating valve $V_R$ and associated orifice 46.

The water flow through the water inlet orifice 44 is increased and this affects the range of sizes of water particles leaving the nozzle 45, the pressure within the mixing chamber 40 and, therefore, the ratio of water to compressed air flow rate increases.

These factors compared with a change in the flow rate through the outlet nozzle affects the size ratio of the particles of water leaving the snow gun. The mix of particle sizes may range between 5 microns and 100 microns which is the preferred mixture of nucleating particles to bulk water particles to achieve optimum efficiency of the snow gun. This enables the density of the deposited snow to be controlled in the range of 10:1 to 3:1 against the traditional 2.4:1 of snow guns which are used for generation of snow outdoors.

The motor M1 further enhances the operation of the snow gun by controlling the size of the water inlet orifice 44. The motor M1 cleans the orifice 44 during the initial phase which reduces the water flow rate and allows for a ratio of 300:1 for the compressed air to water flow rates. This provides a water particle size range from 5 to 40 micron.

When the water bypass solenoid V3 is closed, the motor M1 opens the control orifice 44 to allow more water through. As an alternative to the use of the valve $V_3$, flow control can also be achieved by increasing the range of operation of the motor M1 and orifice 44.

Referring now to FIGS. 6 and 7 there is described means for controlling the ventilation of the body of air within the enclosure. During non snow making activity the body of air should have adequate quality and be at a temperature at or below 0° C. and with the desired humidity. However, as the temperature within the body of air is below 0° C., ice will form on the heat exchanger surfaces by which the space is ventilated resulting in reduced heat transfer rate. Such ice layer needs to be removed by defrosting on a regular basis to maintain sufficient air flow and cooling efficiency. Normally during the defrosting action there will be no ventilation within the body of air. In some circumstances this is disadvantageous, especially with a facility which has high occupancy. In one arrangement shown in FIG. 6 two heat exchangers 50 and 51 are provided in series and in one 50 air is cooled down to about 5° C. The air temperature is reduced and the moisture content of the air is also reduced by condensation without forming ice on the heat exchanger surfaces. Such a heat exchanger can operate continuously and over a range of air volumes without the requirement for defrosting to introduce dry air at the required temperature into the body of air. As an alternative to the heat exchanger 50 a chemical air drier can be used.

A second heat exchanger 51 is provided in series with the first having a further heat exchange facility for reducing the air temperature below 0° C. The further heat exchanger operates with drier air and ice formation should not be such a problem.

In addition to the heat exchangers 50 and 51 there may be provided an optional run-around coil 52 or a plate heat exchanger, preceding the heat exchangers 50 and 51 and contained in the same duct 53 through which air is directed from an inlet 54 to the outlet 55 by means of a fan 56. The heat exchanger 50 is supplied with coolant through a coolant entry pipe 56, return flow being through the pipe 57 fitted with a suitable valve 58 and having a bypass 59.

Air is extracted from the body of air within the envelope by a fan 61 which passes the air through an optional run-around coil 62 to a condenser coil 63, the air being discharged outside the environment through outlet 64.

A refrigeration compressor 65 is associated with a condenser coil 63 and coolant is supplied from the refrigeration compressor 65 to the cooling coil 51.

An alternative to the FIG. 6 arrangement is an arrangement in which a single heat exchanger has the facility for rapid defrosting, so that the interruption to ventilation is of brief duration. In the illustrated arrangement air is drawn in through an opening 70 passed to an optional heat recovery coil 71 and along a chamber 72 to a secondary cooling coil 73 supplied with coolant from a coolant entry and return arrangement 74. A fan 75 draws air in through the outlet 70.

The air then passes over cooling coil assemblies 77 and 78 each having a cooling coil 79, each associated with dampers 80. Coolant to each cooling coil is supplied through a coolant supply arrangement 81 and, when required, defrost cooling may be supplied through an arrangement 82. Air is then discharged into the body of air 11 at 83.

In this arrangement the heat exchanger 79 utilises a coolant/refrigerant and the flow of refrigerant through the heat exchanger is used as a heat pump to rapidly defrost the heat exchanger surfaces. During this procedure, the fan 75 passing air through the heat exchanger stops and on completion of defrosting the heat exchanger 79 is used in the normal mode with fan 75 on and refrigerant/coolant being passed through it to cool the air. The latter arrangement can also be used in the previously described dual heat exchanger system of FIG. 6 in which case the first stage of the heat exchanger would employ the reversing valve for the refrigerant.

Operation of an indoor snow facility utilises a large quantity of water and it is desirable that such water be recycled for re-use. In one arrangement shown in FIG. 8, waste snow is removed at the foot of the inclined snow covered surface. There is provided a receptacle 90 into which the snow is removed, the receptacle being in the form of a holding tank located in the floor. The snow in the tank is melted by means of spraying water from sprays 92 over the surface and this runs down through the snow.

A source of heat 93 may be introduced into the spray water to cause the snow to melt and the heat source can be in the form of a heat exchanger utilising the air conditioning system of the body of air, for example chilled water from the primary cooling system thereby recycling energy necessary to operate the system.

Water from the tank 90 is then passed through a filtration plant 94 which can filter the water by the use of cyclone filters or sand filters. Such filters remove the suspended particles and this water is suitable for use in the cooling system if cooling towers are used. Further purification of the water may be by the addition of ozone or by ultraviolet treatment at 95 which kills any bacteria. The water may then be passed through a high efficiency filter to remove materials such as dead bacteria and a charcoal filter to remove any remaining ozone and prevent damage to the pipe work. Condensate from cooler defrost drains and water from fresh air cooling may also be passed to the tank 90 from sources 96 and 97.

The water recycling system may receive condensate from the ventilation plant or from the defrosting of the heating exchangers. This water can be fed into the snow tank or into a separate storage tank.

The invention claimed is:

1. A method of making snow comprising:

discharging water droplets into a body of air within a closed environment;

maintaining the body of air at a temperature and humidity at least during snow making such as to turn the water droplets to snow in flight, the snow falling on to a surface within said environment;

providing the surface with coolant pipes which in operational use are covered with a layer of snow; and maintaining the temperature of the coolant in said pipes such that the temperature gradient in the snow layer between the coolant and the air above the snow layer is of the order of 0.1 degrees centigrade per centimeter depth, the coolant being at a lower temperature than the air temperature.

2. A method of making snow according to claim 1 further comprising spacing the pipes apart over said surface and laying a thermally conductive material over the pipes and under the snow in use to improve the conduction of the heat of the coolant to the snow layer.

3. A method according to claim 2 wherein the thermally conductive material includes activated alumina and ice, or activated alumina bound with cement.

4. A method according to claim 2 further comprising locating the thermally conductive material and the pipes in recesses in said surface, there being a plurality of recesses lying parallel to and spaced from each other.

5. A method according to claim 1 wherein the coolant temperature is in the range −10° C. to −20° C. and the air temperature above the snow layer is in the range −5° C., to 0° C., the snow layer having a thickness generally in the range 200–1000 mm.

6. A method according to claim 1 comprising discharging the air and water mixture from a snow gun, initially by discharging a relatively small quantity of small water droplets in the air and, thereafter, a relatively larger quantity of droplets per unit volume of air into the main body of air.

7. A method according to claim 6 further comprising providing the snow gun with means for changing the water orifice size by which the water is introduced into the airflow.

8. A method according to claim 1 further comprising introducing air into the body of air to maintain its temperature and humidity through air conditioning means including cold surfaces over which the air passes, and mixing the cooled air during or after passage over the cold surfaces before it is discharged into the body of air.

9. A method according to claim 8 further comprising defining with the cold surfaces an upstream part with a temperature in excess of 0° C. thereby effecting initial cooling and extraction of water, and a downstream part below 0° C. in which the air is cooled to less than 0° C.

10. A method according to claim 8 comprising arranging coolant to pass over at least some of the cold surfaces to heat the surfaces and release ice therefrom during a de-icing operation following a cooling operation.

11. A method of making snow in which snow is made artificially within a closed indoor environment, the method comprising:

discharging a mixture of water droplets and air into a body of air within the environment;

maintaining the body of air at a temperature and humidity, at least during snow making, which causes the water droplets to turn into snow in flight in the body of air;

discharging the water droplets and air from a snow gun in such a manner as to encourage the formation of snow whereby during an initial part of the snow making process a relatively small quantity of small droplets are discharged into the body of air to provide nucleating particles, and thereafter a larger quantity of droplets are discharged; and varying the quantity of water discharged into the body of air via a water orifice size adjustment valve which adjusts the proportion of water droplets in relation to the volume of air discharged by the snow gun.

* * * * *